US005160018A

United States Patent [19]

Alieri

[11] Patent Number: 5,160,018

[45] Date of Patent: Nov. 3, 1992

[54] DEVICE FOR RETAINING CROWN CAPS

[75] Inventor: Rodiero Alieri, Imola, Italy

[73] Assignee: Sacmi Cooperativa Meccanici Imola S.c.r.l., Imola, Italy

[21] Appl. No.: 776,035

[22] Filed: Oct. 15, 1991

[30] Foreign Application Priority Data

Oct. 30, 1990 [IT] Italy ..... 3715 A/90

[51] Int. Cl.[5] ..... B65G 15/46

[52] U.S. Cl. ..... 198/803.6; 269/8; 269/57

[58] Field of Search ..... 198/472.1, 690.1, 803.6; 269/8, 55, 57

[56] References Cited

U.S. PATENT DOCUMENTS 2,687,202 8/1954 Nordquist et al. ..... 198/472.1

3,050,091 8/1962 Meyer ..... 198/803.6

3,164,081 1/1965 Vincze ..... 198/803.6

3,621,979 11/1971 Kraeft ..... 198/803.6

3,941,242 3/1976 Braden ..... 198/803.6

*Primary Examiner*—J. J. Swann

*Attorney, Agent, or Firm*—Guido Modiano; Albert Josif

[57] ABSTRACT

Device for retaining crown caps having a carousel for the support and transfer of the caps which includes a disk which rotates about a vertical axis and is peripherally provided with a series of angularly equidistant recesses which are open outwardly. A stationary ring is superimposed on each disk and peripherally supports a series of magnets. The edge of each recess has an upper lip which protrudes toward the inside of the recess itself, thereby defining an underlying semicircular seat in which a cap is attracted by the respective magnet.

2 Claims, 1 Drawing Sheet

FIG.2
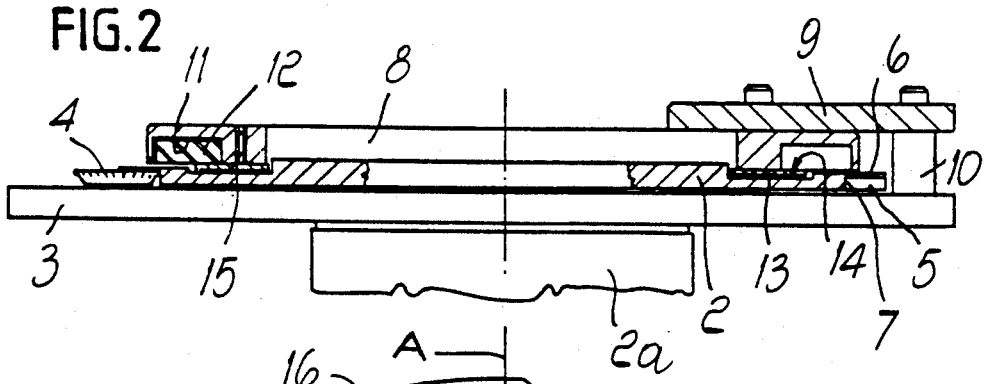
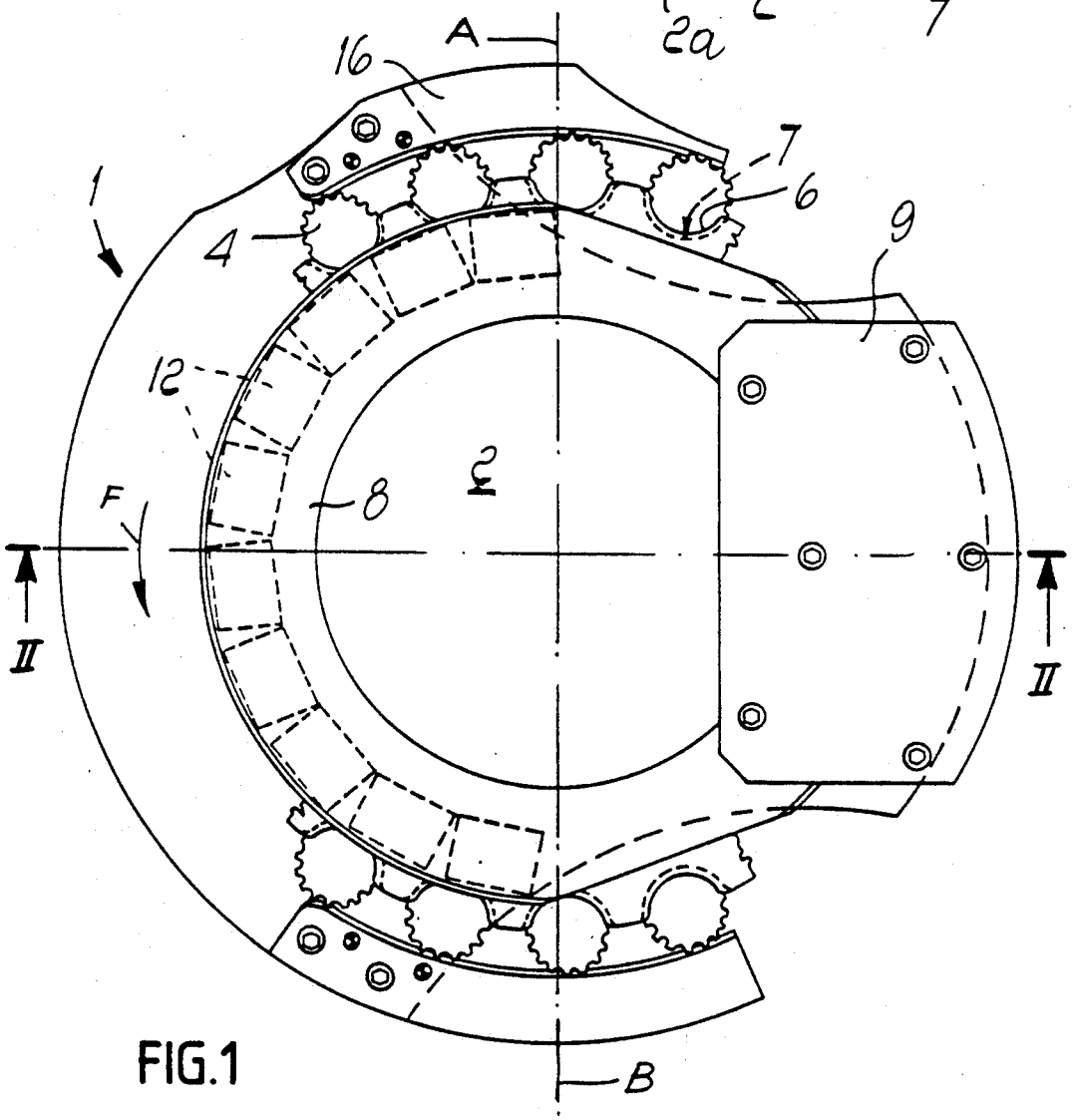
FIG.1

DEVICE FOR RETAINING CROWN CAPS

BACKGROUND OF THE INVENTION

The present invention relates to a device for retaining caps, in particular crown caps, in a machine for forming the sealing gasket inside the caps.

Machines which comprise two carousels which rotate about vertical axes are currently known for forming the gaskets in crown caps.

In one of the carousels, a dose of plastic material in the pasty state is introduced in the caps and is then compressed in the other carousel, by means of appropriate punches so as to form gaskets which line the bottom of the caps and ensure tightness when the caps are applied to the containers.

In order to make the dose of plastic material first and then the gasket adhere to the inner surface of the caps, said caps are heated beforehand so as to liquefy the inner priming coat which acts as adhesive between the gasket and the cap.

Heating occurs by conveying the caps through a magnetic field emitted by a high-frequency inductor. Depending on the nature of the material with which the caps are manufactured, attraction toward the inductor occurs if the material is ferromagnetic or repulsion occurs if the material is diamagnetic, for example aluminum or stainless steel. In order to conveniently increase the efficiency of the inductors, the surface of the caps must pass very close to said inductors without however touching them, in order to avoid short circuits or abrasions of the paint which covers them externally.

For the transfer of the caps from one carousel to the other or for the insertion or removal of the caps in or from the carousels, as well as for the retention of the caps in the carousels, said caps rest toward the inside of appropriate seats defined on the peripheral region of rotating disks (so-called stars) which form an integral part of the carousels and rest outward on fixed guides which extend concentrically with respect to said disks.

Above the caps there is a cover which has the function of providing a better guiding of the caps during advancement, especially if said caps are made of diamagnetic material, which would cause their upward repulsion.

Known cap supporting systems have some severe disadvantages which can be ascribed to the relative movements between the rotating disks and the stationary guides, which cause the wear of the outer guides, produced by the friction of the caps as they advance, and of the seats of the stars, since the advancement of the caps causes the rotation thereof in their seats. These wear phenomena are furthermore aggravated by the magnetic attraction and repulsion force.

Another disadvantage which can be observed in conventional cap conveyance systems is constituted by sparks, which are due to electric discharges which occur in the points of contact between the caps and the fixed guides and are due to currents induced by the magnetic field. Said sparks lead to the wear of the guides and to the damage of the caps.

The accommodation of the caps in the respective seats and their guiding furthermore entail a certain play which, considering the size tolerances of the caps, can cause a misalignment thereof with respect to the punches and therefore centering errors in the formation of the gasket.

A further and not less important disadvantage occurs during the passage of the caps from one carousel to the other, since guides and covers are provided in order to prevent the caps from being left loose during this passage, constituting a constructive complication and being in any case the source of jammings when dimensional deformations or alterations of the caps are added to the negative effects of said plays.

Another disadvantage of conventional conveyance systems is observed in the presence of defective caps which, since they cannot be removed automatically as they are obstructed by the cover, can only be removed manually by stopping the machine.

SUMMARY OF THE INVENTION

The aim of the present invention is therefore to obviate these disadvantages by providing a device which is suitable for retaining the caps in the seats defined in the edges of the respective carousels for the conveyance and transfer of the caps.

Within the scope of this aim, a further object of the invention is to provide a device which is structurally simple and capable of ensuring effective operation.

This aim and these objects are achieved, according to the invention, by the present device for retaining caps in machines of the type which comprises carousels for the support and transfer of said caps which comprise disks which rotate about vertical axes, said disks being peripherally provided with a series of angularly equidistant recesses which are open outward, characterized in that a stationary ring is superimposed on each disk and peripherally supports a series of magnets, and in that the edge of each recess has a lip which protrudes inward, defining an underlying semicircular seat for the engagement of the edge of said caps, said magnets being suitable for attracting and retaining said caps in said semicircular seats.

BRIEF DESCRIPTION OF THE DRAWINGS

Further features of the invention will become apparent from the detailed description of a preferred embodiment of the device for retaining crown caps, illustrated only by way of non-limitative example in the accompanying drawings, wherein:

FIG. 1 is a plan view of a carousel of a machine provided with the device according to the invention;

FIG. 2 is a sectional view of the carousel of FIG. 1, taken along the plane II—II.

DESCRIPTION OF THE PREFERRED EMBODIMENTS

With reference to the above figures, the reference numeral 1 generally indicates a generic carousel station which has a horizontal disk 2 mounted at the top of a shaft which rotates about a vertical axis in a sleeve 2*a*.

The disk 2 is arranged above a base 3 which also constitutes a sliding surface for the caps 4.

The disk 2 has a series of substantially semicircular peripheral recesses 5 which are angularly equidistant and give the disk the appearance of a star. The upper edge of each recess 5 is provided with a lip 6 below which is defined a semicircular seat 7 for engaging the toothed edge of a respective cap 4.

A coaxial ring 8 is superimposed on the disk 2 and is rigidly associated with a stationary bracket 9 which protrudes from a column 10 which is fixed to the base 3.

An annular cavity 11 is defined in the face of the ring 8 which is opposite to the disk 2; said cavity is open downward and is partially superimposed on the inner part of the recesses 5. A plurality of magnets 12 is accommodated in said cavity 11; such magnets provide attraction forces which act on the caps in order to keep such caps engaged in the seats 7.

Said magnets 12 are retained in the cavity 11 by a very thin thrust bearing 13 which partially closes said cavity. Said thrust bearing 13, which engages a channel 14 defined in the upper face of the disk 2 in order to move the magnets closer to the caps, is fixed to the ring 8 by means of a plurality of screws 15.

The operation of the device is as follows.

The caps 4, which can slide on the surface of the base 3, are conveyed in the direction F which is tangent to the carousel one after the other. Each cap, guided by a perimetric external abutment 16, engages a respective recess 5 and is moved by the rotating disk 2. Initially, the caps are caused to advance only by being moved by the disk 2, until they are carried below the region of the magnets 12. As soon as they reach the angular position A, the caps enter the field of attraction of the magnets 13, which causes their lifting from the surface 3. Between the positions A and B, the caps are conveyed so as to be suspended with respect to the surface 3. In position B, at the last magnet 12, the caps leave the field of attraction of the magnets and fall back onto the sliding surface and are moved out of the carousel 1 by the disk 2.

The substantial advantage of the device according to the invention resides in the fact that the caps, contrary to what occurs in conventional cap-making machines, do not slide in the supporting seats or on the supporting surface for most of their path, so that they are not subjected to deterioration due to sliding.

An equally important advantage is observed when the caps 4 have deformations or similar defects. The transfer of the caps in fact does not require covers or the like, so that the deformed caps, by being unable to engage the seats 7, escape the attraction of the magnets 12 and can move freely away from the star 2.

I claim:

1. Device for retaining crown caps comprising a carousel for supporting and transferring said caps which comprises a disk which is rotatable about a vertical axis, said disk being peripherally provided with a series of angularly equidistant recesses which are open outwardly, the device further comprising a stationary ring being superimposed on said disk, said stationary ring peripherally supporting a series of magnets which are positioned at least partially above said recesses, each one of said recesses having an upper protruding lip below which is defined an underlying semicircular seat for accommodating an edge of said caps, said magnets being accommodated in a peripheral cavity which is defined in said ring and which is open downwardly therefrom, said magnets being locked in said cavity by a thrust bearing which is fixed to said ring and which is partially superimposed on an inner side of said magnets, whereby said magnets attract and retain said caps in said semicircular seat.

2. Device for retaining crown caps comprising a carousel for supporting and transferring said caps which comprises a disk which is rotatable about a vertical axis, said disk being peripherally provided with a series of angularly equidistant recesses which are open outwardly, the device further comprising a stationary ring being superimposed on said disk, said stationary ring peripherally supporting a series of magnets which are positioned at least partially above said recesses, each one of said recesses having an upper protruding lip below which is defined an underlying semicircular seat for accommodating an edge of said caps, said magnets being accommodated in a peripheral cavity which is defined in said ring and which is open downwardly therefrom, said magnets being locked in said cavity by a thrust bearing which is fixed to said ring and which is partially superimposed on an inner side of said magnets, wherein said thrust bearing engages a channel defined on an upper face of said disk, whereby said magnets attract and retain said caps in said semicircular seat.

* * * * *